United States Patent [19]

Strauss et al.

[11] Patent Number: 4,832,835

[45] Date of Patent: May 23, 1989

[54] AIR PILLOW IN THE AIR CHAMBERS OF A BOTTOM PULSED JIGGING MACHINE

[75] Inventors: Werner Strauss; Helmut Timmermann; Werner Hasse; Karl-Heinz Weiffen, all of Bochum, Fed. Rep. of Germany

[73] Assignee: Klockner-Humboldt-Deutz AG, Fed. Rep. of Germany

[21] Appl. No.: 56,104

[22] Filed: Jun. 1, 1987

[30] Foreign Application Priority Data

May 30, 1986 [DE] Fed. Rep. of Germany ..... 3618187

[51] Int. Cl.[4] ..... B03B 5/20

[52] U.S. Cl. ..... 209/455; 209/502

[58] Field of Search ..... 209/455–457; 209/502

[56] References Cited

U.S. PATENT DOCUMENTS

| | | | |
|---|---|---|---|
| 3,252,574 | 5/1966 | De Koning et al. | 209/457 |
| 3,285,414 | 11/1966 | Bosman | 209/457 |
| 3,890,223 | 6/1975 | Stern | 209/457 |
| 4,019,981 | 4/1977 | Stern | 209/455 |
| 4,559,135 | 12/1985 | Strauss | 209/455 |

FOREIGN PATENT DOCUMENTS

| | | | |
|---|---|---|---|
| 1153691 | 4/1961 | Fed. Rep. of Germany | 209/455 |
| 2539374 | 3/1977 | Fed. Rep. of Germany | 209/457 |
| 41206 | 4/1967 | Japan | 209/455 |
| 1192856 | 11/1985 | U.S.S.R. | 209/455 |

OTHER PUBLICATIONS

Batac Jig Publication by Raymond E. Zimmerman entitled A New Improved Baum Type Jig for Cleaning Coarse and Fine Sizes of Coal, May 1974.

*Primary Examiner*—William L. Freeh

*Attorney, Agent, or Firm*—Hill, Van Santen, Steadman & Simpson

[57] ABSTRACT

A method and apparatus for treating minerals such as coal in a jig bed having a downwardly opening air chamber beneath the bed wherein the chamber has an air compartment at the upper end retaining a cushioned pillow of air between each jig pulsation with controlled air admitted and relieved from the chamber so that when air is relieved, the water rising in the chamber compresses the air at the upper end and a cushion of air is retained so that with admission of pressurized air, the cushion aids in forcing the column of water from the chamber, particularly at the beginning of operation of the jig.

8 Claims, 1 Drawing Sheet

AIR PILLOW IN THE AIR CHAMBERS OF A BOTTOM PULSED JIGGING MACHINE

BACKGROUND OF THE INVENTION

The invention relates to improvements in a jigging machine wherein a pulsation is given to a bed of minerals such as coal flowing along a horizontal surface to separate undesirable materials.

More particularly, the invention is directed to a method for generating water pulsations in a jigging machine for processing minerals, particularly coal, whereby one or more downwardly open air chambers under the jig bed are supplied with pressurized air from an air dome for lifting the jigged material from the jig bed. Air is subsequently pressed out of the chamber by lowering the water in the jig bed.

Continuous intermittent up and down jigging motion is given the mineral on the jig bed by the continual intermittent supply of pressurized air into the compartment and release of the air from the compartment. Normal operation in devices heretofore available supplied a predetermined amount of pressurized air into the chamber and then completely relieved the air from the chamber so that the water in the jig bed completely filled the air chamber between each pulsation.

The air chambers under the individual jig bed compartments are usually supplied from a common air dome. Since different water movements are required in the individual compartments, attempts have been made to achieve optimum water movements in every compartment on the basis of a control such as valves, pivoted flaps, and pivoting blades. However, even when the charging stock does not change very much in qualitative terms, such an optimization is inadequate because the separation effect is also significantly defined by the quantity on the jig bed and quantitative fluctuations of the jigging stock are unavoidable. The separating result is therefore usually unsatisfactory over a longer time and during the start-up operation as well.

Up to now, developments have been directed toward a more and more powerful and complicated jig bed control. With the assistance of air control circuits and of a freely programmable control, particularly specific start-up programs, it is fundamentally possible to individually change the opening and closing points in time for filling and emptying the air chambers given fluctuations of the charging quantity and, in particular, during start-up, this requiring highly trained personnel and raising problems of maintenance and trouble-shooting.

An object of the invention is to provide and operate a jigging machine such that fluctuations in the charging stock and fluctuations during start-up of the jigging machine remain governable. In particular, such that an "outage" of more heavily loaded compartments does not occur, such that a constrained pulsation of the water in every compartment arises and that the required operating measures no longer need be so involved that only highly trained personnel can keep the machines running through unavoidable, unexpected fluctuations and deviations. An object is to obtain self-stabilizing controls to take effect in the machine.

In terms of method, this object is achieved in that the energy of the compressed air from the air dome is first at least partially used for the compression of an air pillow in the air chamber which is constantly present. The object is achieved by a jigging machine which is characterized in that the admission and discharge of the air into and out of the air chamber occurs at such a height that a space remains when water penetrates into the chamber from below and an air cushion remains above this opening in the chamber.

Up to now, for example, a jig compartment that was overfilled threatened to fail because less and less air per pulsation period could flow from the air dome into the pulsation chamber because of the excessively loaded jig bed. The bed together with the water in the compartment offered greater and greater resistance and, when discharging the air, more and more air was displaced from the working chamber and, thus, the reserved volume became smaller and smaller. Pressure and admission time could not simply be increased because air would have otherwise have punched through into the other compartments.

What is effected by the air pillow of the invention is that the water pulsations never entirely cease or, in other words, that water pulsations can always be excited.

This operating mode is also utilized during start-up. Water proceeds into the air admission and discharge of the chambers up to a certain limited height. From air from the air dome, this relatively small water volume can always be pressed out. Air is adjacent in the upper end compartment of the air chamber. When pressurized air is admitted into the chamber, the entire water mass is not immediately placed in motion. A greater part is initially converted into compression energy since, in accord with the invention, a minimum air cushion should always remain in the air chamber. During expansion of the air, the compressed air pillow then in turn acts as a motor which presses onto the overall quantity of water in the pulsation chamber, this always being adequate in practical operation to generate jigging water pulsations.

This type of energy transmission also takes particular effect during start-up of the jigging machine. It thereby basically no longer occurs that one compartment no longer "responds" because it would require especially great quantities of energy due to an overloaded jig bed and the pressure energy from the air dome has already flowed into the compartments that were less heavily loaded during the time available, these compartments having offered less resistance to the commencement of the water motion.

It is beneficial for improving the method to additionally provide air control per compartment. That is, to adjust the fine control with the means of electronics whereby the system always remains stable. Thus, the total failure of the water pulsations is no longer possible. A defined quantity of energy is always introduced into every compartment independently of the load because of the air cushion. Of course, as hitherto, the quantity of jigging stock is an important dimensioning quantity in the design of the conduit size, the size of the air cushion and the shape of the chamber.

There have been controls wherein probes and a corresponding valve control prevented one chamber from being fully filled with jigging water, retaining a defined air cushion in the chamber, this having been generated before start-up (German Published Application No. 25 27 756). In contrast to the known "active" control susceptible to disruption, the method of the invention is an operating mode which occurs automatically, wherein at most, smaller corrections are required but wherein the desired behavior essentially occurs automatically.

It is preferred to maintain such an air cushion in the chamber and to fashion the upper region of the chamber such that the size of the cross section of the chamber is equal to the size of the air bubble, i.e., the "full" piston surface should be immediately available upon expansion. What this means for the apparatus is that the top compartment or section of the chamber is always filled with air for the full cross section and it is particularly beneficial to fashion the chamber roof as a "flat roof". The size of the air cushion is then determined by the distance of the admission and discharge opening from the top of the chamber. The distance of the opening to the top is then approximately proportional to the volume of the "air bubble" in the air chamber. In general, the bottom-pulsed jigging machine of the invention is characterized in that the admission and discharge of the air into and out of the air chamber occur at such a height that a space remains in the chamber above the air opening and air remains enclosed in this space when water enters into the chamber from below.

The characteristic of the jigging process is changed only slightly with such a jigging machine. In the method of the invention and the apparatus of the invention, there is definitely the possibility of operating the jigging machine "softer" because a pulsation can always be excited. This operating mode is especially important in the superfine grain range. Over and above this, energy savings also derive from a soft operating mode.

In accordance with the features of the invention, the energy of the compressed air supplied to the air chamber which is normally supplied from the air dome is at least partially used for a further compression of the air pillow which is present above the water level at the top of the air chamber. Thus, in the start-up condition of the jig, the movement of the water is caused by summation of the energy of the air in the air dome and the stored energy of the air pillow. It is, therefore, significant that the pulse pressure act on the entire free surface of the water column in the chamber so that a significantly larger pressure surface is located at the top of the water column in the chamber and the water column acts as a piston.

In methods heretofore available, only a small cross sectional area of the supplied air pressure acted on the water column as a working pressure surface, particularly during the start-up procedure. This disadvantage occurred in previously known jigging machines where the pulse chambers were completely filled with water at start-up. As a result of the present concept, the overall energy introduced into the air chamber operates on a larger working piston surface and the water column can be easily pushed out of the chamber for the first jigging stroke of the jig bed.

During the operating condition of the arrangement, the water column is pushed downwardly out of the chamber for the full amount of pressurized air supplied to the chamber and as a result a complex valve control is no longer required for maintaining a minimum level. Previous arrangements involved valve control because there was a risk that the water level within the chamber migrated to the extent that air blew out through the bottom of the chamber. In the present arrangement a stable water level is achieved within the chamber and the blow through of air from the chamber is avoided. With the present arrangement, the air pillow is formed above the opening into the chamber and the air pillow exercises a damping effect on the upwardly pulsing water column and stores energy in its compressed condition in order to give the water column a correspondingly high kinetic energy following the upper dead point. The downwardly directed movement of the water column is significantly accelerated by the stored energy of the air pillow and also by the energy of the compressed air from the air dome supply. The pulsating water column in the air chamber assumes the function of a valve control since the water column periodically releases and recloses the opening used for the introduction and release of the air from the chamber.

The ratio of the working area of the jigging compartment to the piston area of the water column could be chosen on the order of a preferred ratio. That is, the ratio of the working area of the jigging compartment to the piston area of the water column should be on the order of 2 to 1. In large previously known jigging machine such ratio was more on the order 3.5 to 1.

Other objects, advantages and features will become more apparent with the teaching of the principles of the invention in connection with the disclosure of the preferred embodiment thereof in the specification, claims and drawings, in which:

DESCRIPTION OF THE PREFERRED EMBODIMENTS

Figure 1:
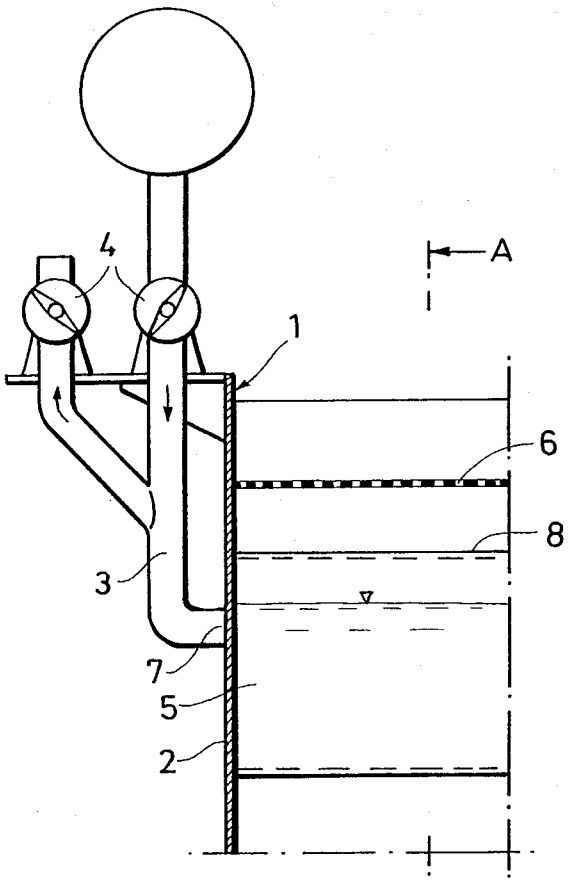
FIG. 1 is a somewhat schematic longitudinal sectional view through a jigging machine constructed and operating in accordance with the principles of the present invention.

As illustrated in the drawings, the mechanism illustrated schematically is a bottom pulsed wet jigging machine such as used for processing coal. The mechanism includes a tank or container 1 with a support bed 6 therein on which the coal is supported. The tank is filled with water and within the tank are one or more air chambers 5 which open downwardly. Air to cause the vertical pulsation of water within the chamber 5 is admitted or released through an opening 7 in the face wall 2 of the chamber 5. A conduit 3 connects to the opening 7 for conducting pressurized air supplied to the chamber and for conducting relief air released from the chamber. Pressurized supply air is obtained from an air dome shown in the upper portion of FIG. 1 controlled through a control valve to flow downwardly as indicated by the arrowed line in the conduit 3. Release air is controlled through a similar valve also shown at 4 flowing in the direction of the arrowed line to the left branch portion of the conduit 3.

An air cushion automatically remains in the upper portion of the chamber 5. The air admission and release opening 7 of the air conduit 3 is positioned a distance A from the roof 8 of the air chamber. The chamber 5 is of uniform dimensions for the major portion of its height from at least below the opening 7 to the lower open end so that the piston surface at the top of the column of water is always the same as the column of water rises or falls within the chamber 5.

Figure 3:
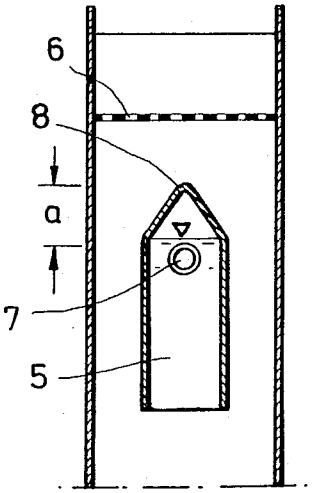
FIG. 3 is a cross sectional view also taken substantially along line A—A of FIG. 1 illustrating another form of air chamber.
Figure 2:
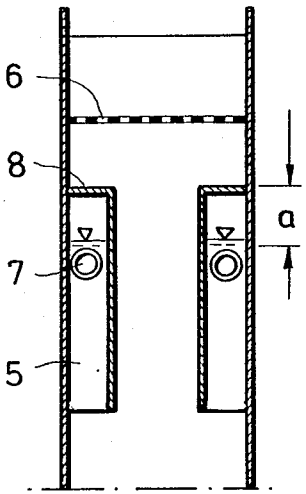
FIG. 2 is a sectional view taken substantially along line A—A of FIG. 1 illustrating one form of air chamber.

In the arrangement of FIG. 2, air chambers are shown which lie against the side walls of the jig tank. In the arrangement of FIG. 3, an air chamber is shown which is centrally located between the side walls of the jig tank. In each case the lower end of the chambers 5 are open. In operation, prior to starting the jig, an air cushion or air pillow is formed in the top of the chamber 5. This air cushion is compressed to the amount caused by the head of water in the jig tank. Then, at start-up, pressurized air is first delivered through the conduit 3 so that initially the air entering through the inlet 7 slightly further compresses the cushion of air and then proceeds to force the column of water downwardly within the chamber 5. The descending column of water causes an upward flow of water in the tank through the bed 6 for the beginning of the jigging effect. When the column of water has descended a distance within the chamber 5, air is released through the opening 7 in a predetermined quantity so that the column of water in the chamber 5 again rises to a point where the water covers the inlet 7. At that point, the release of air is cut off. Or, in some cases, the chamber may be self-operating in that the water column covering the opening 7 will essentially terminate and block the escape of air. Further rise in the column of water within the chamber 5 compresses the air cushion in the top end of the chamber 5 to where pressure equalization is attained. That is, the back pressure of the water column will then equal the compression of the air cushion in the top of the chamber 5. For the next pulsation, air is again admitted through the inlet 7 to initially slightly compress the air cushion further and then begin to force the column of water downwardly in the chamber 5. Thus, it will be seen that a cushioning or elastic effect is occasioned both at the beginning of the pulsation and at the end. At the beginning, the entrance of air through the inlet 7 first starts compressing the pillow or cushion of air further, but gradually in an accelerating manner pushes the column of water downwardly. When the flow of inlet air is stopped, and air is released through the opening 7, the column of water 5 again raises and as it passes the opening 7, the release of air is cut off and the rising column of water in a decelerating manner is stopped by the air cushion at the top of the chamber 5. Thus, the up and down movement of the column of water in the chamber 5 which causes the jigging effect on the bed of material 6 is smooth so that an improved jigging effect ensues. This air cushion is particularly useful at the time of start-up as described above.

Thus, it will be seen that we have provided an improved method and apparatus for a mineral jig which meets the objectives and advantages above set forth, and which accomplishes an improved jigging pattern and avoids difficulties heretofore encountered. While, for simplicity of drawing, a single air chamber is shown, multiple air chambers will normally be used which if given individual overriding control, will avoid any of the chambers being locked so that a more uniform jigging or pulsation effect can be enjoyed by the bed throughout its area.

As above indicated, the dimension a which measures the distance from the top or the roof of the chamber 5 is carefully chosen so that the remaining air cushion will be commensurate with the type of mineral to be processed and the expected operation of the jigging machine. Whatever distance a is chosen, the air cushion is the significant quantity to have an effect on the column of water in the chamber. The total height of the chamber is chosen so that as the air column lowers and rises with the pulsating jigging effect, air will not escape from the chamber but will be admitted and relieved through the opening 7.

We claim as our invention:

1. The method of generating water pulsations in an air pulsed jigging machine for processing minerals such as coal having a jig bed with a submerged air chamber therein opening downwardly and with a pulsating controlled air supply connected to the chamber through an inlet outlet opening means in the chamber with the chamber having a pillow chamber air compartment formed at the upper end thereof, and the opening means spaced downwardly from the upper end of the chamber to form a pillow chamber above the opening, comprising the steps:

introducing pulsed air pressure into said chamber through said opening means for forcing water downwardly in the downwardly facing open chamber to generate a pulsation beneath the bed, the downward movement of the water being aided by the compressed air in the pillow chamber;

intermittently relieving air from the chamber through the opening means to allow the water to rise over the opening means allowing the water column to rise in the chamber against the pillow chamber; and retaining a substantial quantity of air in the pillow chamber at the upper end of the chamber above the opening means between pulsations so that the water column compresses said quantity of air above the opening means between pulsations and the compressed air in the pillow chamber acts as a resilient air pillow and aids in the initiation of the expulsion of water from the chamber with each introduction of pressurized air into the chamber.

2. The method of generating water pulsations in an air pulsed jigging machine for processing minerals such as coal having a jig bed with a submerged air chamber therein opening downwardly and with a pulsating controlled air supply connected to the chamber through an inlet outlet opening means in the chamber with the chamber having an air compartment formed at the upper end of the chamber in accordance with the steps of claim 1:

including terminating the relief of air from the air compartment so that essentially the same size air pillow remains in said compartment with each pulsation.

3. The method of generating water pulsations in an air pulsed jigging machine for processing minerals such as coal having a jig bed with a submerged air chamber therein opening downwardly and with a pulsating controlled air supply connected to the chamber through an inlet outlet opening means in the chamber with the chamber having an air compartment formed at the upper end of the chamber in accordance with the steps of claim 1:

including positioning said inlet outlet opening means a substantial distance from the upper end of the chamber so that said means is covered with rising water with each intermittent release of air from the chamber.

4. The method of generating water pulsations in an air pulsed jigging machine for processing minerals such as coal having a jig bed with a submerged air chamber therein opening downwardly and with a pulsating controlled air supply connected to the chamber through an inlet outlet opening means in the chamber with the chamber having an air compartment formed at the upper end of the chamber in accordance with the steps of claim 1:

including sizing the cross-sectional area of the chamber relative to the size of the bed so that an area ratio on the order of 2 to 1 is formed.

5. The method of generating water pulsations in an air pulsed jigging machine for processing minerals such as coal having a jig bed with a submerged air chamber therein opening downwardly and with a pulsating controlled air supply connected to the chamber through an inlet outlet opening means in the chamber with the chamber having an air compartment formed at the upper end of the chamber in accordance with the steps of claim 1:

wherein the size of the chamber including the size of its opening and the size of the air pillow remaining in the air compartment are matched to the mean load and mean water movement in the compartment as a function of the movement of the bed.

6. An apparatus for generating water pulsations in an air pulsed jigging machine for processing minerals such as coal, comprising in combination:

a jig bed with a water container having a horizontal mineral supporting bed at the top;

a downwardly opening chamber within the container with the chamber having a pillow chamber at the upper end;

an air inlet outlet opening means within the chamber spaced from the upper end thereof;

a controlled air supply line leading to the opening for the admission of pressurized air into the chamber;

a controlled air relief line connected to the opening means to vent the opening means to atmospheric pressure;

a control means for the admission and discharge of air from the chamber intermittently admitting and relieving air from the chamber so that as air is relieved from the chamber an air cushion remains at the upper end and the water in the chamber rises compressing the air therein;

said air inlet opening spaced downwardly from the upper end of said chamber a substantial distance and at a location so that the opening is covered with water as the water rises due to compression of the air in the chamber above the opening between pulsations which are caused by admission of air through the supply line.

7. An apparatus for generating water pulsations in an air pulsed jigging machine for processing minerals such as coal in accordance with claim 6:

wherein the air outlet opening means is spaced a substantial distance from the top of the chamber and at a location so that the opening is covered with water as the water rises to compress the air in the air compartment when air from the supply line is shut off at the termination of operation.

8. An apparatus for generating water pulsations in an air pulsed jigging machine for processing minerals such as coal in accordance with claim 6:

wherein the cross-sectional size of the jig bed relative to the cross-sectional area of the chamber is of a size having a ratio on the order of 2 to 1.

* * * * *